US011680776B2

(12) United States Patent
Nielsen

(10) Patent No.: US 11,680,776 B2
(45) Date of Patent: Jun. 20, 2023

(54) RAIL INTERFACE SYSTEMS AND METHODS OF MOUNTING ACCESSORIES TO A FIREARM

(71) Applicant: Doug Nielsen, North Judson, IN (US)

(72) Inventor: Doug Nielsen, North Judson, IN (US)

( * ) Notice: Subject to any disclaimer, the term of this patent is extended or adjusted under 35 U.S.C. 154(b) by 0 days.

(21) Appl. No.: 17/336,971

(22) Filed: Jun. 2, 2021

(65) Prior Publication Data

US 2021/0372739 A1 Dec. 2, 2021

Related U.S. Application Data

(60) Provisional application No. 63/033,398, filed on Jun. 2, 2020.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 3,276,127 A 10/1966 Abrahamson
3,513,549 A 5/1970 Smiley
3,611,606 A 10/1971 Sefried et al.
3,737,232 A * 6/1973 Milburn, Jr. ..... G02B 23/14 356/18
3,835,565 A 9/1974 Weast
3,992,783 A * 11/1976 Dunlap ..... F41G 11/003 42/124
4,205,473 A 6/1980 Wilson
4,841,659 A * 6/1989 Williams ..... F41G 1/10 D22/109
5,694,712 A 12/1997 Plonka
5,887,375 A * 3/1999 Watson ..... G03B 29/00 42/106
8,468,735 B1 * 6/2013 Keng ..... F41G 1/08 42/148
8,726,562 B1 * 5/2014 Hoskisson ..... F41G 11/003 42/126
8,806,799 B1 * 8/2014 Gordon ..... F41G 1/01 42/130
D713,921 S * 9/2014 Williams ..... D22/109
D715,393 S * 10/2014 Williams ..... D22/109
RE45,724 E * 10/2015 Dueck ..... F41G 1/02
9,417,034 B1 * 8/2016 Swan ..... F41G 11/007
9,441,915 B2 * 9/2016 Zimmer ..... F41G 11/003
9,459,078 B1 * 10/2016 Kincel ..... F41G 11/004
9,488,446 B2 * 11/2016 Zimmer ..... F41G 1/02
10,030,935 B1 * 7/2018 Ding ..... F41G 1/17
10,036,614 B1 * 7/2018 Ruiz ..... F41G 11/003
(Continued)

*Primary Examiner* — Michelle Clement
(74) *Attorney, Agent, or Firm* — Hartman Global IP Law; Gary M. Hartman; Domenica N. S. Hartman

(57) ABSTRACT

Rail interface systems and methods of mounting accessories to a firearm therewith. The rail interface systems are configured to be installed on a firearm equipped with a first firearm accessory mounted to the firearm with at least one mounting assembly. The rail interface system includes a rail interface configured to couple with a second firearm accessory, and rail fasteners configured to secure the rail interface to the mounting assembly of the first firearm accessory.

15 Claims, 4 Drawing Sheets

(56) References Cited

U.S. PATENT DOCUMENTS 10,048,040 B1 * 8/2018 Ratliff ..... F41G 11/003
10,088,277 B2 * 10/2018 Zimmer ..... F41G 11/003
10,119,787 B2 * 11/2018 Geissele ..... F41G 11/003
10,337,837 B2 * 7/2019 Keller ..... F41G 1/065
10,359,258 B2 * 7/2019 Geissele ..... F41G 11/003
10,495,417 B1 * 12/2019 Geissele ..... F41G 11/003
10,627,191 B1 * 4/2020 Fischer ..... F41G 11/008
11,060,815 B1 * 7/2021 Novak ..... F41C 27/00
11,067,365 B2 * 7/2021 Roberson ..... F41G 11/003
11,112,216 B1 * 9/2021 Fan ..... F41G 11/00
2002/0162267 A1 * 11/2002 Nelson ..... F41G 11/003 42/120
2004/0216352 A1 11/2004 Wooten et al.
2006/0026888 A1 * 2/2006 Cheng ..... F41G 11/004 42/146
2007/0039225 A1 * 2/2007 Kallio ..... F41G 1/35 42/146
2008/0148619 A1 * 6/2008 Rogers ..... F41G 11/003 42/90
2010/0058640 A1 * 3/2010 Moore ..... F41G 1/36 42/114
2011/0308130 A1 * 12/2011 Holmberg ..... F41G 1/473 356/4.01
2011/0310476 A1 * 12/2011 Russ ..... G02B 23/18 359/407
2012/0060402 A1 * 3/2012 Dueck ..... F41G 1/02 42/137
2012/0085014 A1 4/2012 Riley et al.
2012/0168589 A1 7/2012 Riley
2012/0311909 A1 * 12/2012 Cheng ..... F41C 27/00 42/90
2012/0311910 A1 * 12/2012 Mironichev ..... F41C 27/00 29/401.1
2013/0000176 A1 * 1/2013 Goertzen ..... F41G 11/003 42/90
2013/0008072 A1 * 1/2013 Chung ..... F41G 1/30 42/113
2013/0061506 A1 * 3/2013 Atkinson ..... F41G 11/003 42/90
2013/0185985 A1 * 7/2013 Ballard ..... F41G 1/00 42/148
2013/0318852 A1 * 12/2013 Teetzel ..... F41C 27/00 42/90
2014/0047755 A1 * 2/2014 McClintock ..... F41C 27/00 42/90
2014/0068991 A1 * 3/2014 Jung ..... F41G 11/003 42/90
2014/0068994 A1 * 3/2014 Schultz ..... F41G 11/003 42/124
2014/0096429 A1 * 4/2014 Sandler ..... F41G 11/003 42/124
2014/0123532 A1 * 5/2014 Russ ..... G02B 23/14 42/113
2014/0150324 A1 * 6/2014 Keng ..... F41G 1/30 42/118
2014/0157644 A1 * 6/2014 Jiminez ..... F41G 11/003 42/114
2014/0190062 A1 * 7/2014 Turner, Jr ..... F41G 11/003 42/124
2014/0196349 A1 * 7/2014 Rogers ..... F41G 1/35 42/90
2014/0230306 A1 * 8/2014 Arachequesne ..... F41G 1/38 42/119
2014/0259854 A1 * 9/2014 Williams ..... F41G 1/387 42/124
2014/0360077 A1 * 12/2014 Miller ..... F41G 1/387 42/84
2015/0040456 A1 * 2/2015 Zimmer ..... F41G 1/02 42/90
2015/0205066 A1 * 7/2015 Gibson ..... G02B 7/04 29/428
2015/0292837 A1 * 10/2015 Cheng ..... F41G 1/38 42/123
2016/0102941 A1 * 4/2016 Brucker ..... F41G 1/033 42/148
2016/0209176 A1 * 7/2016 Zimmer ..... F41G 11/004
2016/0258716 A1 * 9/2016 Haugen ..... F41G 11/003
2016/0341522 A1 * 11/2016 Davis ..... F41G 11/003
2016/0363416 A1 * 12/2016 Klotz ..... F41C 27/00
2016/0377384 A1 * 12/2016 Keeney ..... F41G 1/10 42/90
2017/0082402 A1 * 3/2017 Zimmer ..... F41G 11/001
2017/0205200 A1 * 7/2017 Geissele ..... F41G 1/393
2017/0254615 A1 * 9/2017 Kennair, Jr. ..... F41G 11/003
2017/0299337 A1 * 10/2017 Ding ..... F41G 11/004
2017/0350675 A1 * 12/2017 Prater ..... F41G 3/08
2018/0073840 A1 * 3/2018 Kristoffersen ..... F41G 1/38
2018/0135946 A1 * 5/2018 Geissele ..... F41G 11/003
2018/0180386 A1 * 6/2018 Keller ..... F41G 11/003
2018/0195838 A1 * 7/2018 Storch ..... F41G 11/001
2019/0011225 A1 * 1/2019 Sun ..... F41G 1/545
2019/0107370 A1 * 4/2019 Galli ..... F41G 11/003
2019/0277605 A1 * 9/2019 Geissele ..... F41G 11/003
2020/0025522 A1 * 1/2020 Zimmer ..... F41G 11/001
2020/0041890 A1 * 2/2020 Peel ..... F41J 5/10
2020/0064102 A1 * 2/2020 Galli ..... F41G 1/35
2020/0132414 A1 * 4/2020 Shelton ..... F41G 11/003
2020/0271422 A1 * 8/2020 Ramirez ..... F41G 11/003
2021/0055078 A1 * 2/2021 Roberson ..... F41G 11/003
2021/0254923 A1 * 8/2021 Summers ..... F41B 5/1403
2021/0262766 A1 * 8/2021 Roberson ..... F41G 11/001
2021/0293512 A1 * 9/2021 Duncan, III ..... F41G 11/003
2021/0372736 A1 * 12/2021 Zhou ..... F21V 21/0885
2022/0049933 A1 * 2/2022 Gerber ..... F41G 11/003

* cited by examiner

RAIL INTERFACE SYSTEMS AND METHODS OF MOUNTING ACCESSORIES TO A FIREARM

CROSS-REFERENCE TO RELATED APPLICATIONS

This application claims the benefit of U.S. Provisional Application No. 63/033,398 filed Jun. 2, 2020, the contents of which are incorporated herein by reference.

BACKGROUND OF THE INVENTION

The present invention generally relates to firearms and firearm accessories. The invention particularly relates to a rail interface system for attaching accessories to firearms, including but not limited to pistols and rifles.

Rail interface systems are used by both military and civilians for attaching and mounting accessories to firearms. Such accessories commonly include tactical lights, laser aiming modules, forward hand grips for improving weapon handling, telescopic sights for long-range targets, and reflex sights/red-dot sights for short/medium-ranged targets, back-up iron sight, bipods/tripods, and bayonets. The rail interface systems are used to improve the usability of the weapon by promoting quick and efficient accessory mounting thereon without requiring a user to disassemble the firearm. Various types of systems exist including standardized rail interface systems such as but not limited to a Picatinny-type rail interface (MIL-STD M1913), a Weaver-type rail interface, or a variation or adaptation of these, such as the NATO STANAG 2324 rail interface. These rail interfaces are similar, in that each defines a pair of parallel longitudinal rails (continuous or discontinuous) and slots that extend laterally between the rails and are spaced longitudinally along the length of the rail interface. These interfaces differ primarily by the width and spacing of their slots. Each type of system is compatible with various commercial firearm accessories. Despite the many variations and benefits of available rail interface systems, there is an ongoing demand for improved rail systems that further promote the usability of firearms.

BRIEF DESCRIPTION OF THE INVENTION

The present invention provides rail interface systems and methods of mounting accessories to a firearm therewith.

According to one aspect of the invention, a rail interface system is provided that is configured to be installed on a firearm equipped with a first firearm accessory mounted to the firearm with at least one mounting assembly. The rail interface system includes a rail interface configured to couple with a second firearm accessory, and rail fasteners configured to secure the rail interface to the mounting assembly of the first firearm accessory.

According to another aspect of the invention, a method is provided for adapting a firearm equipped with a first firearm accessory mounted thereto to mount a second firearm accessory. The method includes securing a rail interface with rail fasteners to a mounting assembly that secures the first firearm accessory to the firearm, and coupling the second firearm accessory to the rail interface.

Technical effects of the system and method described above preferably include the ability to secure additional firearm accessories to a firearm without disassembling the firearm and without removing other firearms accessories already mounted on the firearm.

Other aspects and advantages of this invention will be further appreciated from the following detailed description.

DETAILED DESCRIPTION OF THE INVENTION

Figure 1:
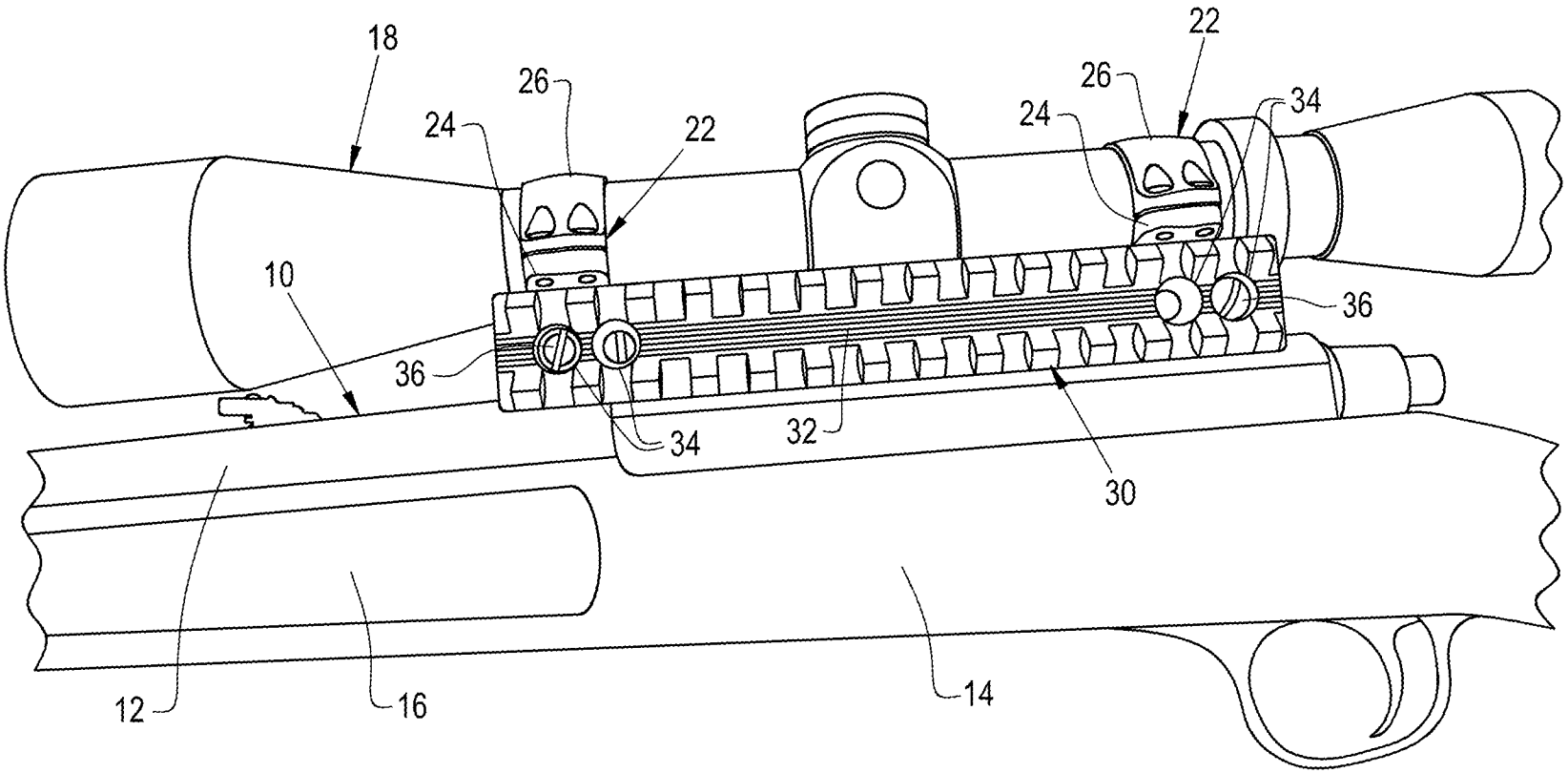
FIGS. 1 and 2 show a rail interface system coupled to a rifle in accordance with certain nonlimiting aspects of the invention.

The intended purpose of the following detailed description of the invention and the phraseology and terminology employed therein is to describe what is shown in the drawings, which include the depiction of one or more nonlimiting embodiments of the invention, and to describe certain but not all aspects of the embodiment(s) depicted in the drawings. The following detailed description also identifies certain but not all alternatives of the depicted embodiment(s). Therefore, the appended claims, and not the detailed description, are intended to particularly point out subject matter regarded as the invention, including certain but not necessarily all of the aspects and alternatives described in the detailed description.

Figure 2:
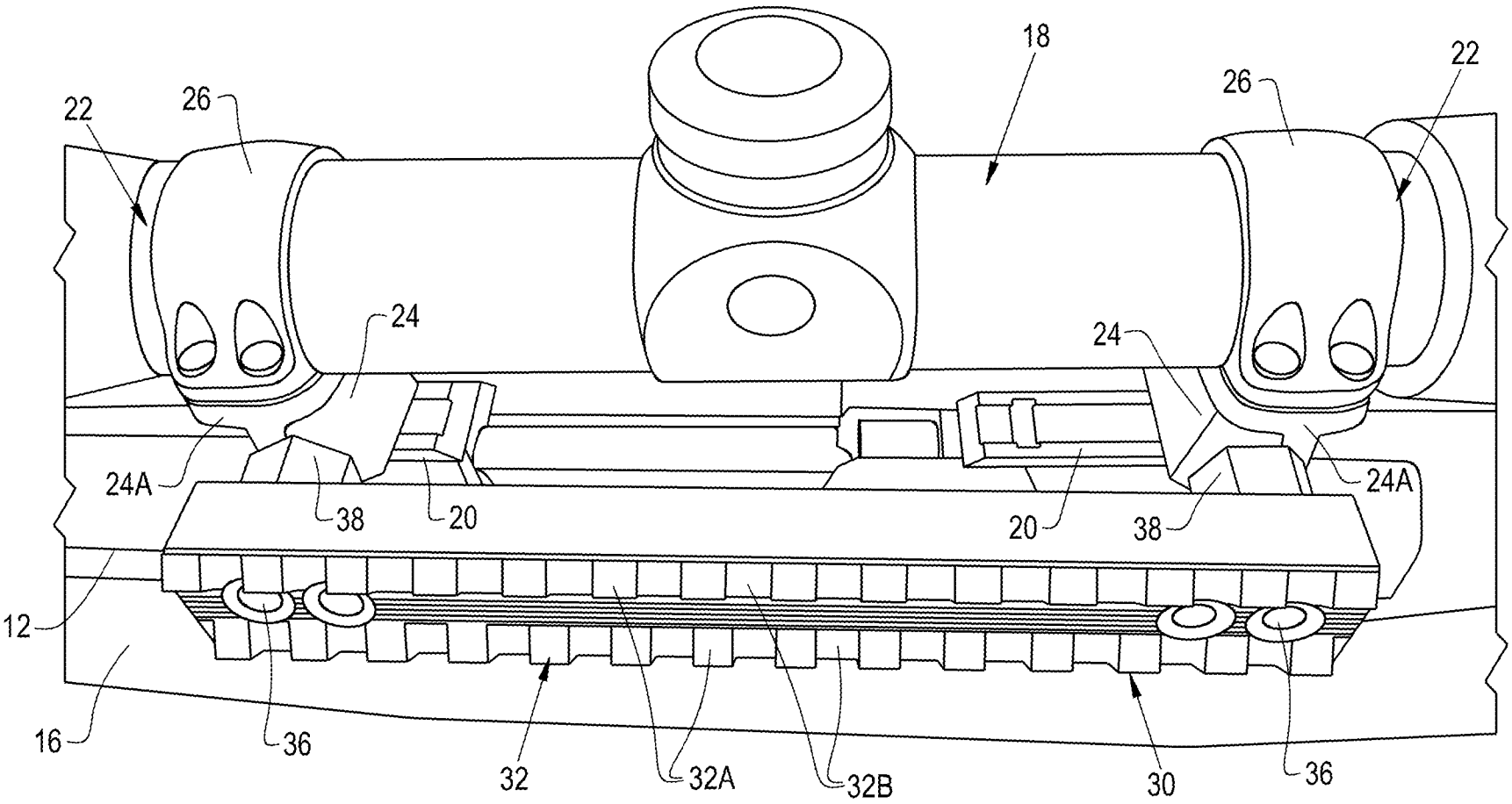
Figure 3:
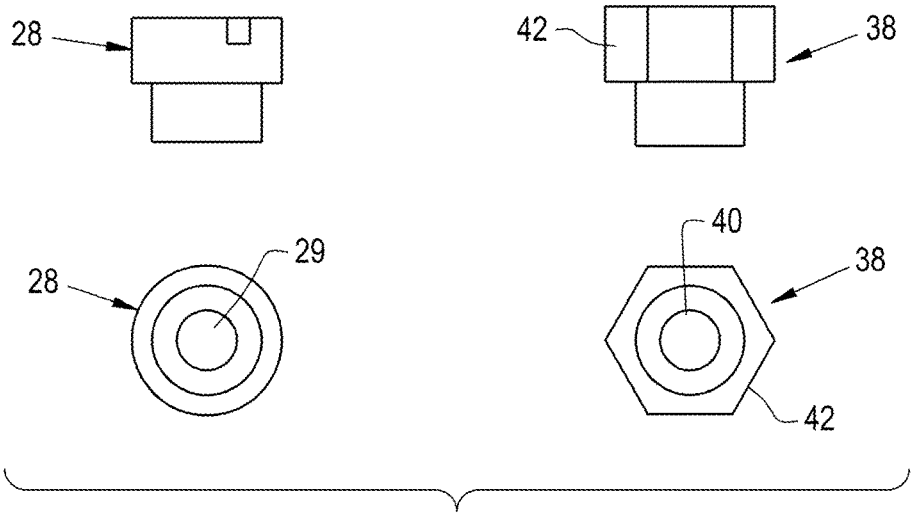
FIG. 3 shows original and replacement clamping nuts for a conventional telescopic sight and the rail interface system of FIGS. 1 and 2.
Figure 4:
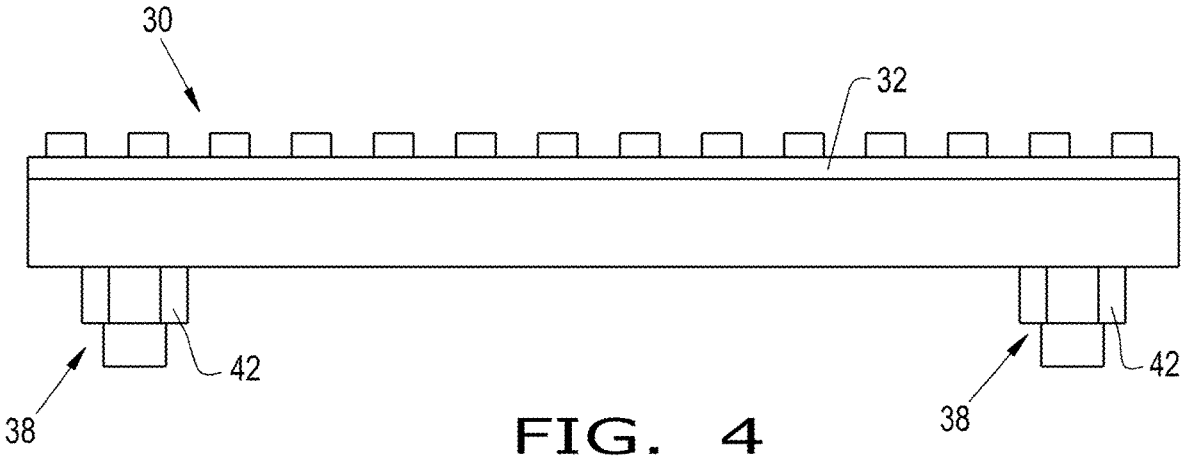
FIG. 4 shows an isolated view of the rail interface system of FIGS. 1 and 2.
Figure 5:
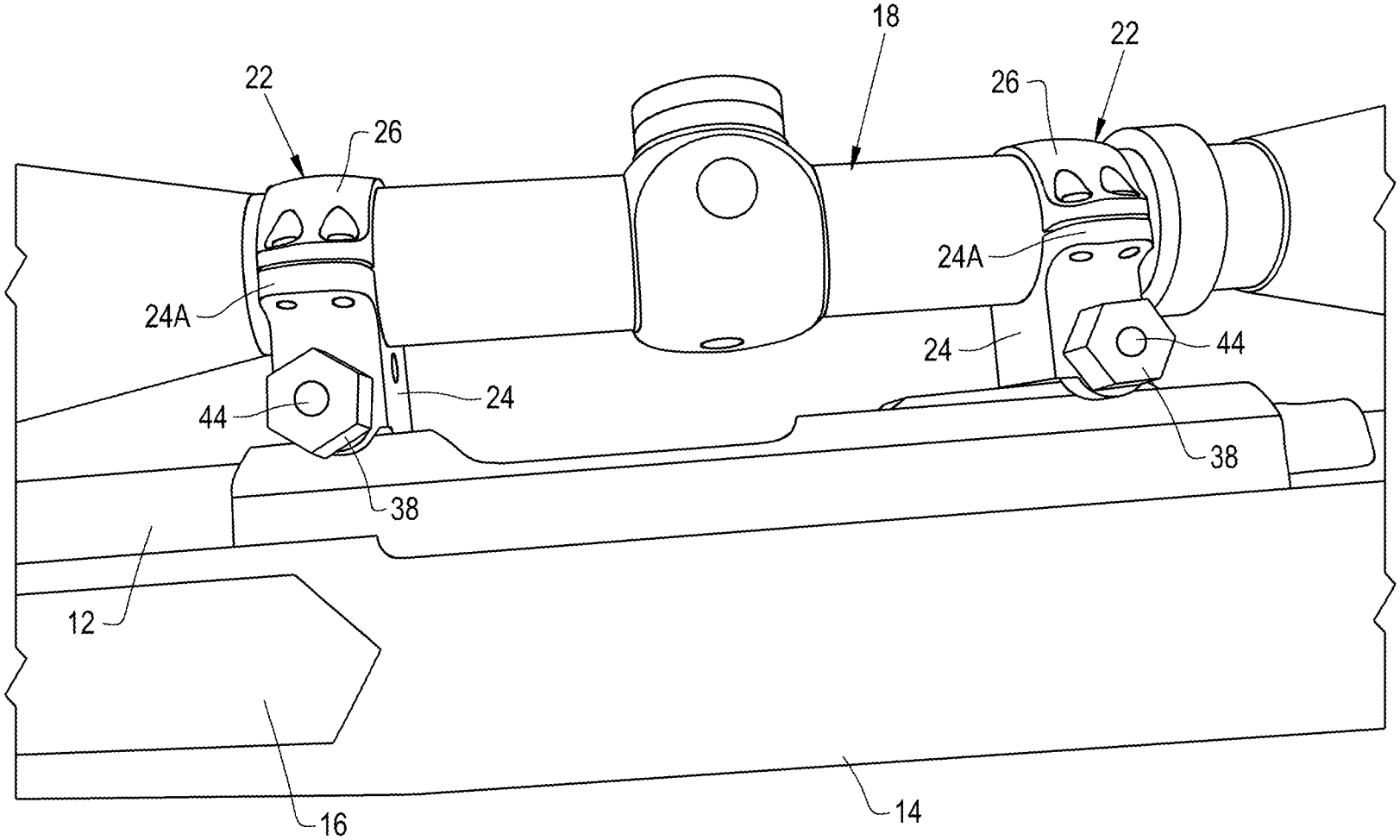
FIG. 5 shows the rifle of FIG. 1 with the replacement clamping nuts of the rail interface system coupled to the telescopic sight on the rifle.

FIGS. 1 through 5 represent a nonlimiting embodiment of a rail interface system 30 capable of adapting a firearm equipped with a firearm accessory to mount at least one additional firearm accessory thereto. The invention will be particularly described in reference to mounting a firearm accessory to a rifle 10 (not shown in its entirety), as represented in FIGS. 1, 2, and 5. For purposes of this description, the rifle 10 will be described as including a barrel 12, a receiver 14, a forearm 16, and a stock (not shown). The stock is coupled to the receiver 14 and extends rearward from the receiver 14. The barrel 12 and the forearm 16 are coupled to the receiver 14 and extend forward from the receiver 14. The terms rear, rearward, back, and the like are used to refer to the general direction of the rifle where the butt is located. The terms front, forward, and the like are used to refer to the general direction of the rifle 10 where the muzzle is located.

Rail interface systems of this invention may be applicable to other types of firearms and equipment, including but not limited to shotguns, pistols, archery bows, paintball guns, and pellet guns. Furthermore, the invention will be described in reference to a standardized rail interface, specifically a Picatinny-type rail interface, though other types of rail interfaces are also within the scope of the invention, such as a Weaver-type rail interface or a variation or adaptation of the Picatinny-type or Weaver-type rail interfaces. The rail interface systems of this invention are well suited for mounting a variety of accessories to firearms, including but not limited to tactical lights and laser aiming modules.

FIGS. 3 and 4 show isolated components of the rail interface system 30 including a Picatinny-type rail interface 32 and replacement clamping nuts 38 (FIGS. 2 through 5) adapted to secure the rail interface 32 to an existing rail interface system of a firearm accessory, for example, a rail interface system located along the top of the receiver 14. Consistent with conventional Picatinny-type rail interfaces, the rail interface 32 includes a pair of parallel longitudinal rails 32A and slots 32B that extend laterally between the rails 32A and are spaced longitudinally along the length of the rail interface 32 (FIG. 2). Unlike various other rail interface systems, the rail interface system 30 of this embodiment is not intended to couple (though may be capable of coupling) directly to the rifle 10, but instead the rail interface system 30 is configured to be indirectly coupled with the rail interface system of a firearm accessory that is independently coupled by the rail interface system to the rifle 10. A nonlimiting example of such a firearm accessory is represented in the drawings as a conventional telescopic sight 18 (referred to hereinafter as the scope 18), and a nonlimiting example of such a rail interface system for mounting the scope 18 is represented in the drawings as comprising dovetail rails 20 located along the top of the receiver 14. In the nonlimiting example shown in the drawings, the scope 18 is mounted to the rails 20 with a pair of ring-type mounting assemblies 22, which serve as intermediate components that indirectly couple the rail interface system 30 to the rails 20.

The mounting assemblies 22 may be of any suitable type capable of mounting to the dovetail rails 20 or any other rail interface system with which the rifle 10 may be equipped. In the nonlimiting embodiment shown, the ring-type mounting assemblies 22 are each represented as including a base 24 that is configured to secure its associated mounting assembly 22 to a rail 20 of the rifle 10. For example, the mounting assemblies 22 may each include a conventional attachment mechanism, for example, a clamp or other suitable component capable of securing each base 24 to a corresponding one of the rails 20. In the example illustrated, the attachment mechanism associated with each base 24 may be a clamping assembly that conventionally utilizes a nut 28 (FIG. 3) to operate a clamp that secures the base 24 to one of the rails 20. The clamp may be mounted to or, in the embodiment shown, formed integral with the base 24. In such an example, each attachment mechanism includes a threaded bolt (concealed within the base 24) that passes through aligned holes in the base 24 and threads into a threaded bore 29 (FIG. 3) in a respective one of the nuts 28, such that tightening the nuts 28 onto their respective bolts secures the bases 24 to the dovetail rails 20. Note that "hole" may encompass a slot or any other alternative means for securing the base 24 to the rails 20. Each mounting assembly 22 further includes a saddle 24A (labeled in FIGS. 2 and 5) that may be mounted to or formed integral with the base 24, a mounting cap 26, and bolts for securing the mounting cap 26 to the saddle 24A. The saddle 24A and cap 26 are configured as two segments of a ring adapted to surround and grip the scope 18.

The rail interface system 30 may be coupled to the mounting assemblies 22 by removing the original clamping nuts 28 and replacing them with the replacement clamping nuts 38 of the rail interface system 30. As with the nuts 28 they replace, the clamping nuts 38 each have a threaded bore 40 (FIG. 3) into which a threaded bolt of the existing mounting assemblies 22 of the scope 18 threads such that tightening the nuts 38 onto their respective bolts secures the bases 24 to the dovetail rails 20, as well as secures the nuts 38 to the mounting assemblies 22 as shown in FIG. 5. Each nut 38 is represented as having a head 42 having a hexagonal form so that a wrench can be used to tighten the nut 38 onto a mounting assembly 22, though other means of tightening the nuts 38 are foreseeable. Each threaded bore 40 is located within a shank at an end of the nut 38 opposite the head 42 of the nut 38. The rail interface 32 may then be secured to the replacement clamping nuts 38 with threaded fasteners (screws) 36 that pass through holes 34 in the rail interface 32 and threadably couple with internal threaded holes 44 (FIGS. 3 and 5) of the clamping nuts 38 located within their heads 42, and therefore opposite the threaded bores 40. This arrangement, in which the nuts 38 and screws 36 in combination serve as rail fasteners, provides for the rail interface system 30 to be quickly and easily secured to the rifle 10 without disassembly of the rifle 10 itself and preferably without removing accessories that are already mounted on the rifle 10, such as the scope 18. Once the rail interface 32 is coupled to the mounting assemblies 22 of the scope 18 (or other firearm accessory), various additional firearm accessories may be releasably mounted to the rail interface 32. As evident from FIGS. 1 and 2, mounting the rail interface 32 to the mounting assembly 22 by coupling the nuts 38 to the mounting assembly 22 results in the rail interface 32 being positioned laterally to one side of the receiver 14 and the mounting assembly 22 thereto, and generally alongside the mounting assembly 22 such that the rail interface 32 is at an elevation relative to the rifle 10 that is higher than (and in some cases above) the receiver 14 but lower than (and in some cases below) the scope 18. A preferred aspect of the invention is that the rail interface 32 and nuts 38 are made with sufficient precision so that an accessory mounted to the rail interface 32 is accurately aligned with the barrel 12 of the rifle 10. In the case where the accessory is a tactical light or a laser aiming module, the accessory can be accurately aligned so that a light beam emitted therefrom can be adjusted to align with the approximate trajectory of a bullet propelled from the rifle 10.

Notably, the rail interface system 30 is not limited to attachment to the type of accessory or mounting assemblies shown and described herein. Rather, the specific mounted arrangement of the rail interface system 30 is one example of an approach for providing a rail interface system configured in accordance with an embodiment of the present invention on a rifle with a scope coupled thereto. In view of the disclosures made herein, a skilled person will appreciate other approaches for coupling the rail interface system 30 to other types of firearm accessories and/or mounting systems associated therewith.

Therefore, while the invention has been described in terms of a specific or particular embodiment, it should be apparent that alternatives could be adopted by one skilled in the art. For example, the rail interface system 30 and its components could differ in appearance and construction from the embodiment described herein and shown in the figures, functions of certain components of the rail interface system 30 could be performed by components of different construction but capable of a similar (though not necessarily equivalent) function, and various materials could be used in the fabrication of the rail interface system 30 and/or its components. Accordingly, it should be understood that the invention is not necessarily limited to any embodiment described herein or shown in the figures. It should also be understood that the phraseology and terminology employed above are for the purpose of describing the disclosed embodiment, and do not necessarily serve as limitations to the scope of the invention. Therefore, the scope of the invention is to be limited only by the claims.

The invention claimed is:

1. A rail interface system installed on a firearm equipped with a first firearm accessory mounted to the firearm with at least one mounting assembly on top of a receiver of the firearm, the mounting assembly having a first rail interface facing in an upward direction on top of the receiver and a clamping assembly that includes first threaded fasteners adapted for releasably clamping the mounting assembly to the first rail interface, the rail interface system comprising:

a second rail interface configured to couple with a second firearm accessory;

clamping nuts each having a threaded bore by which each of the clamping nuts is threaded onto a corresponding one of the first threaded fasteners; and second threaded fasteners threaded into threaded holes of the clamping nuts to secure the second rail interface to the mounting assembly of the first firearm accessory, wherein the first and second threaded fasteners and the threaded bores and the threaded holes of the clamping nuts are coaxially aligned and secure the second rail interface to the mounting assembly;

wherein the second rail interface is positioned laterally to one side of the receiver at an elevation lower than the first firearm accessory mounted to the firearm with the mounting assembly.

2. The rail interface system of claim 1, wherein the second rail interface comprises a pair of parallel longitudinal rails and slots that extend laterally between the pair of parallel longitudinal rails and are spaced longitudinally along the length of the second rail interface.

3. The rail interface system of claim 1, wherein the second rail interface is a Picatinny-type rail interface (MIL-STD M1913), a Weaver-type rail interface, or a NATO STANAG 2324 rail interface.

4. The rail interface system of claim 1, wherein the second threaded fasteners comprise screws that pass through holes in the second rail interface and are threadably coupled to the threaded holes of the clamping nuts.

5. The rail interface system of claim 4, wherein:

the threaded bores are in shanks of the clamping nuts; and the threaded holes are in heads of the clamping nuts.

6. The rail interface system of claim 5, wherein each of the heads of the clamping nuts has a hexagonal form so that a wrench can be used to tighten the replacement clamping nut onto the mounting assembly.

7. The rail interface system of claim 1, wherein the second rail interface faces in a lateral direction that is perpendicular to the upward direction of the first rail interface.

8. The rail interface system of claim 7, wherein the elevation of the second rail interface relative to the firearm is higher than the receiver.

9. The rail interface system of claim 1, wherein the first firearm accessory is a telescopic sight.

10. The rail interface system of claim 1, wherein the firearm is a rifle.

11. A method of using a rail interface system to adapt a firearm equipped with a first firearm accessory mounted thereto to mount a second firearm accessory, the first firearm accessory being mounted to the firearm with at least one mounting assembly on top of a receiver of the firearm, the mounting assembly having a first rail interface facing in an upward direction on top of the receiver and a clamping assembly that includes first threaded fasteners releasably clamping the mounting assembly to the first rail interface, the method comprising:

removing installed clamping nuts from the first threaded fasteners;

securing a second rail interface to the firearm by threading replacement clamping nuts onto the first threaded fasteners to releasably reclamp the mounting assembly to the first rail interface, and then threading second threaded fasteners into threaded bores of the clamping nuts, the first and second threaded fasteners and the threaded bores of the clamping nuts being coaxially aligned and securing the second rail interface to the mounting assembly; and coupling the second firearm accessory to the second rail interface.

12. The method of claim 11, wherein the second rail interface faces in a lateral direction that is perpendicular to the upward direction of the first rail interface.

13. The method of claim 11, wherein the second rail interface is mounted to the mounting assembly with the first and second threaded fasteners and the threaded bores of the clamping nuts such that the second rail interface is positioned laterally to one side of the receiver and the mounting assembly at an elevation relative to the firearm that is higher than the receiver but lower than the first firearm accessory.

14. The method of claim 11, wherein the first firearm accessory is a telescopic sight.

15. The method of claim 11, wherein the firearm is a rifle.

* * * * *